US006552965B2

(12) United States Patent
Brandt et al.

(10) Patent No.: US 6,552,965 B2
(45) Date of Patent: Apr. 22, 2003

(54) ELECTRONIC CLOCK

(75) Inventors: Kenneth A. Brandt, Wyndmere, ND (US); Scott R. Rossow, Kindred, ND (US); Trevor Fuss, Fargo, ND (US); Ryon Boen, Minneapolis, MN (US)

(73) Assignee: Clark Equipment Company, Woodcliff Lake, NJ (US)

( * ) Notice: Subject to any disclaimer, the term of this patent is extended or adjusted under 35 U.S.C. 154(b) by 0 days.

(21) Appl. No.: 09/768,730

(22) Filed: Jan. 24, 2001

(65) Prior Publication Data

US 2002/0018403 A1 Feb. 14, 2002

Related U.S. Application Data

(60) Provisional application No. 60/221,810, filed on Jul. 31, 2000.

(51) Int. Cl.[7] ..... G04F 8/00; G04F 10/00; G04B 47/00

(52) U.S. Cl. ..... 368/107; 368/10; 368/111; 368/113

(58) Field of Search ..... 368/1, 8–10, 41, 368/46–47, 107–113, 118, 82–84

(56) References Cited

U.S. PATENT DOCUMENTS

| | | | | | |
|---|---|---|---|---|---|
| 4,150,333 | A | * | 4/1979 | Edwards | 368/118 |
| 4,168,525 | A | * | 9/1979 | Russell | 702/178 |
| 5,229,981 | A | * | 7/1993 | Maschi | 368/111 |
| 6,069,848 | A | * | 5/2000 | McDonald | 368/107 |
| 6,252,823 | B1 | * | 6/2001 | McDonald | 368/9 |
| 6,282,152 | B1 | * | 8/2001 | Kurple | 368/10 |

* cited by examiner

*Primary Examiner*—David Martin
*Assistant Examiner*—Michael L. Lindinger
(74) *Attorney, Agent, or Firm*—Westman, Champlin & Kelly

(57) ABSTRACT

A clock stores time data indicative of time of operation of a power machine. A timing circuit provides a timing signal and a controller is coupled to a timing circuit and to a memory, which includes a plurality of memory locations. An elapsed time value is maintained, based on the timing signal, by the timing circuit, and a subset of a plurality of memory locations is intermittently updated with the elapsed time value.

21 Claims, 8 Drawing Sheets

ELECTRONIC CLOCK

The present application is based on and claims the benefit of U.S. Provisional Patent Application Ser. No. 60/221,810, filed Jul. 31, 2000, the content of which is hereby incorporated by reference in its entirety.

BACKGROUND OF THE INVENTION

The present invention deals with power machines. More specifically, the present invention deals with an electronic clock for use as an hour meter in a power machine.

Power machines, such as skid steer loaders and mini-excavators, often require maintenance which is performed based on a number of hours of operation of the power machine. The number of hours of operation can give maintenance personnel an idea of what parts might be wearing, and what maintenance operations should be considered and performed.

Such power machines often operate in fairly hostile conditions. In other words, the power machines are often operated at construction sites over various extremely rugged terrains, and in environments which are filled with dust, snow, mud and other debris. Similarly, such power machines can operate in electronically noisy environments where electronic signaling encounters difficulty.

In spite of these difficult operating conditions, it is still desirable to maintain the hour meter for the power machine (i.e. the electronic clock) with a high degree of accuracy. Therefore, in prior systems, the hour meter was implemented with an electronic controller and a timing circuit. The actual hour meter value was stored at three separate locations in memory. At predetermined intervals, the controller would write an updated hour meter value to all three locations in memory. The write operations were performed substantially simultaneously. While this system did substantially improve the accuracy by reducing problems associated with bad memory locations and by reducing the problems associated with single bad memory write operations, the system still had disadvantages.

For instance, if the hour meter data being written by the controller was somehow corrupted, this corrupted data would be written to all three memory locations such that all three locations would then contain corrupted data. Similarly, the prior clocks wrote to all three memory locations upon power-up and power-down. However, due to different circuits in the control system powering down at different times, and glitches which can occur on signal and power lines during power-down, the hour meter value at power-down can be inaccurate. Therefore, again, all three memory locations would be written with inaccurate data.

SUMMARY OF THE INVENTION

A clock stores time data indicative of time of operation of a power machine. A timing circuit provides a timing signal and a controller is coupled to a timing circuit and to a memory, which includes a plurality of memory locations. An elapsed time value is maintained, based on the timing signal, by the timing circuit, and a subset of a plurality of memory locations is intermittently updated with the elapsed time value.

DETAILED DESCRIPTION OF THE ILLUSTRATIVE EMBODIMENTS OVERVIEW

The present invention proceeds with respect to a loader described below. However, it should be noted that the present invention can be implemented in other power machines, such as mini-excavators, as well. The present invention is described with respect to the loader for illustrative purposes only.

Figure 1:
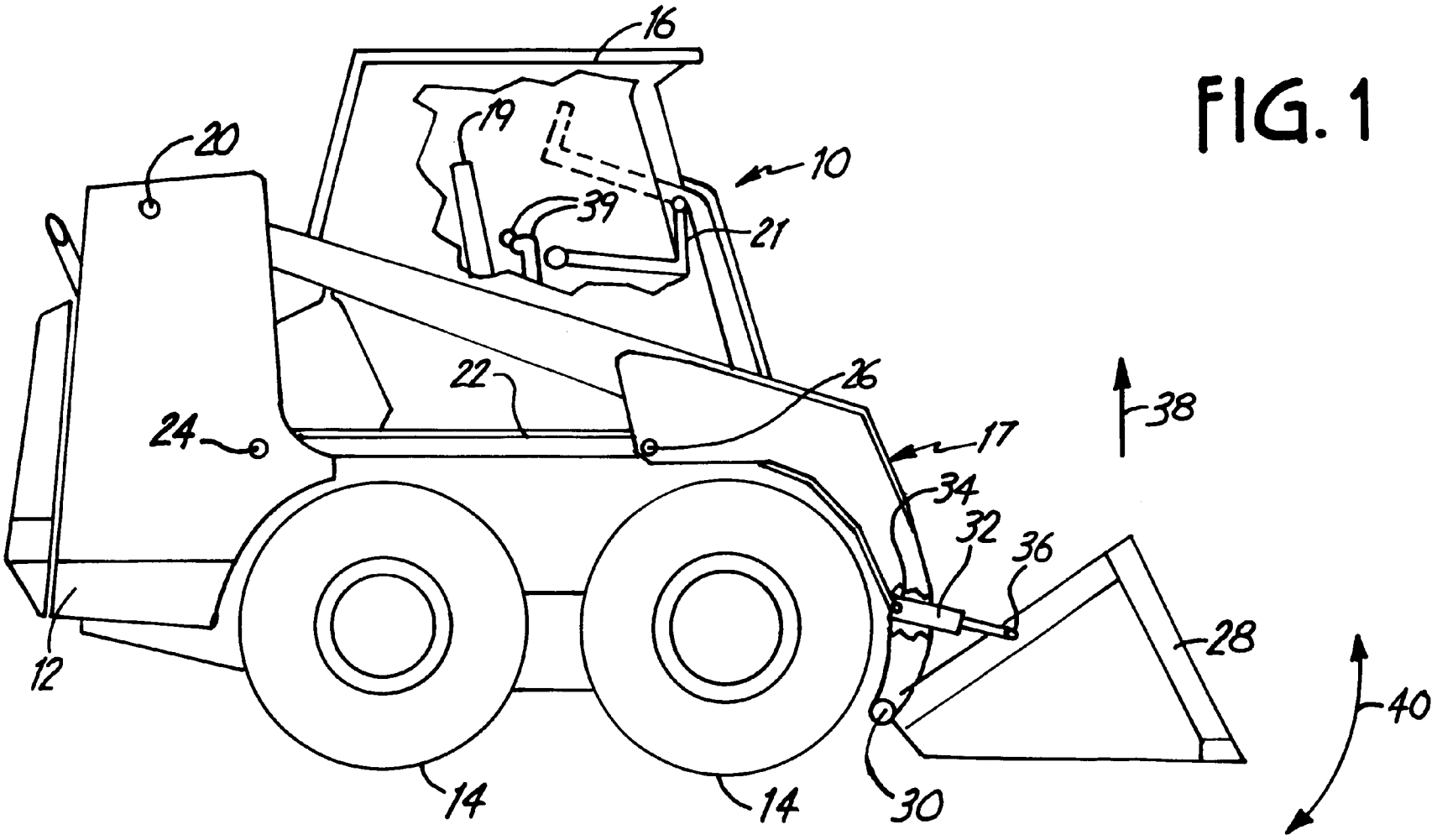
FIG. 1 is an illustration of a power machine in accordance with one embodiment of the present invention.

FIG. 1 is a side elevational view of a skid steer loader 10 of the present invention. Skid steer loader 10 includes a frame 12 supported by wheels 14. Frame 12 also supports a cab 16 which defines an operator compartment and which substantially encloses a seat 19 on which an operator sits to control skid steer loader 10. Cab 16 can take any shape desired and is illustrated with the shape shown for illustrative purposes only. A seat bar 21 is pivotally coupled to a portion of cab 16. When the operator occupies seat 19, the operator then pivots seat bar 21 from the raised position (shown in phantom in FIG. 1) to the lowered position shown in FIG. 1. It should also be noted that seat bar 21 can be a rear pivot seat bar or can take substantially any other form.

A lift arm 17 is coupled to frame 12 at pivot points 20 (only one of which is shown in FIG. 1, the other being identically disposed on the opposite side of loader 10). A pair of hydraulic cylinders 22 (only one of which is shown in FIG. 1) are pivotally coupled to frame 12 at pivot points 24 and to lift arm 17 at pivot points 26. Lift arm 17 is also coupled to a working tool which, in this preferred embodiment, is a bucket 28. Lift arm 17 is pivotally coupled to bucket 28 at pivot points 30. In addition, another hydraulic cylinder 32 is pivotally coupled to lift arm 17 at pivot point 34 and to bucket 28 at pivot point 36. While only one cylinder 32 is shown, it is to be understood that any desired number of cylinders could be used to work bucket 28 or any other desired tool.

The operator residing in cab 16 can manipulate lift arm 17 and bucket 28 by selectively actuating hydraulic cylinders 22 and 32. By actuating hydraulic cylinders 22 and causing hydraulic cylinders 22 to increase in length, the operator moves lift arm 17, and consequently bucket 28, generally vertically upward in the direction indicated by arrow 38. Conversely, when the operator actuates cylinder 22 causing it to decrease in length, bucket 28 moves generally vertically downward to the position shown in FIG. 1.

The operator can also manipulate bucket 28 by actuating cylinder 32. When the operator causes cylinder 32 to increase in length, bucket 28 tilts forward about pivot points 30. Conversely, when the operator causes cylinder 32 to decrease in length, bucket 28 tilts rearward about pivot points 30. The tilting is generally along an arcuate path indicated by arrow 40.

FIG. 1 also illustrates a plurality of hand controls, or hand grips 39 which reside within the operator compartment 16. Hand grips 39 are illustratively provided with a number of actuators (such as push buttons, potentiometers, switches, etc.) which can be manipulated by the operator to accomplish certain functions. The operator-actuable inputs on hand grips 39 in one illustrative embodiment provide electrical signals to a control computer (described in greater detail later in the specification) which controls certain functions of loader 10 in response to the signals received.

In addition, in one illustrative embodiment, one or more operator input and display panels (shown in FIG. 2) are provided in operator compartment 16. The operator input display panels provide a display for indicating certain items of information to the operator, and also provide additional operator input devices, such as a membrane keypad, a touch sensitive screen, etc., through which the operator can provide inputs.

It should, however, be noted that inputs can be provided in a mechanical way as well. For instance, hand grips 39 can be coupled to levers which control valve spools or solenoids through mechanical linkages. Similarly, foot pedals can be provided in operator compartment 16 which also control valve spools or solenoids through mechanical linkages.

In addition, loader 10 illustratively has one or more auxiliary hydraulic couplings (not shown in FIG. 1) which can be provided with quick disconnect type fittings. Hydraulic pressure to the auxiliary couplings can also be controlled based on signals from one or more of the operator input devices within operator compartment 16.

Figure 2:
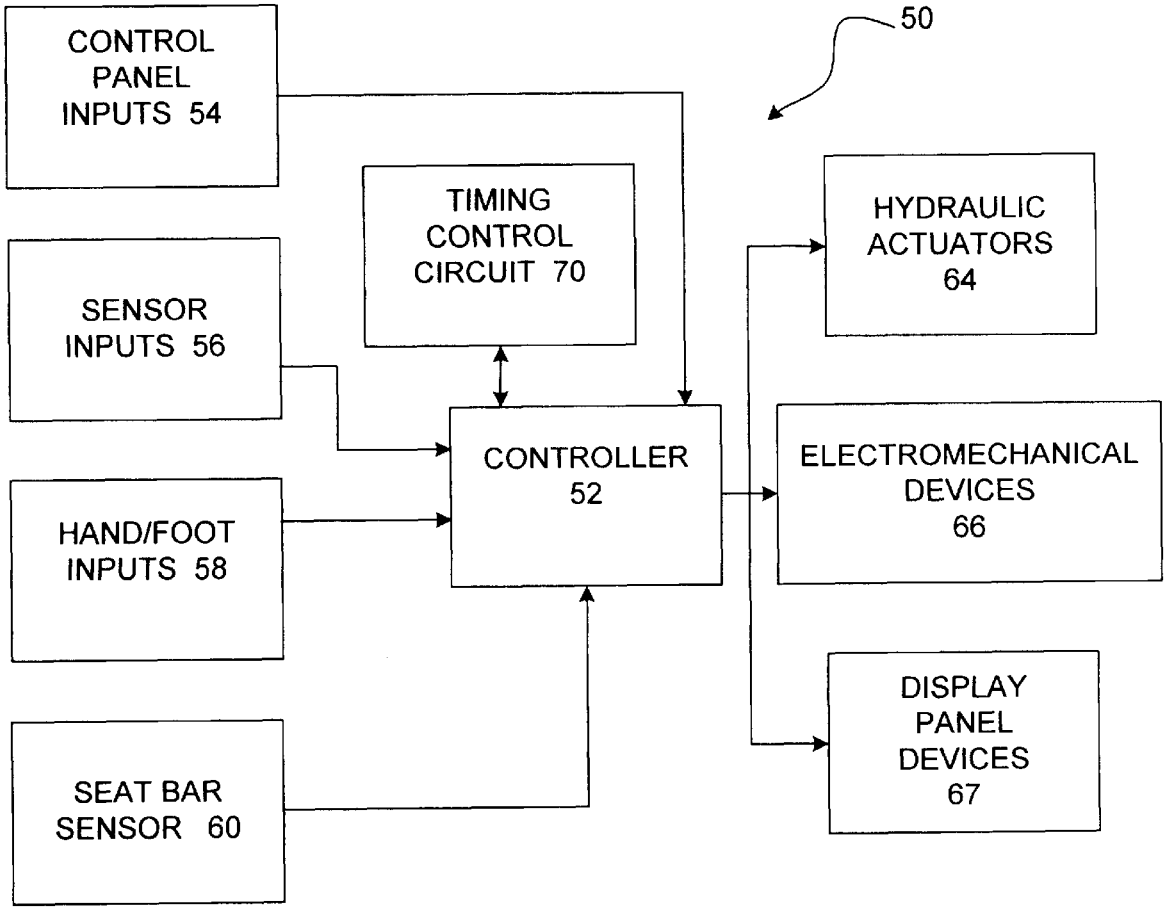
FIG. 2 is a block diagram of a control system for the power machine shown in FIG. 1.

FIG. 2 is a block diagram of one embodiment of a control system 50. System 50 includes controller 52, control panel inputs 54, sensor inputs 56, hand/foot inputs 58, sensor 60, hydraulic actuators 64, electro-mechanical solenoids 66, timing control circuit 70, and display panel devices 67. Controller 52 is illustratively a digital computer, microprocessor, or microcontroller with associated memory which can be integrated or provided separately.

Control panel inputs 54 can include a wide variety of operator interfaces used to control such features as headlights, interlock systems, ignition, etc. This information can be transmitted to controller 52 via direct digital inputs, a one-way serial stream or any number of bi-directional serial communication protocols. Similarly, the connection between control panel inputs 54 and controller 52 illustratively includes power and ground connections as well.

Sensor inputs 56 can also include a wide variety of analog or digital sensors or frequency inputs indicative of operating conditions or other sensed items, such as an engine oil pressure sensor, a fuel sensor, an engine cooling sensor, an air filter sensor (which indicates reduced air flow—thus indicating a clogged air filter), an engine speed sensor, a hydraulic oil temperature sensor, a hydraulic oil charge pressure sensor, and/or a hydraulic oil filter pressure switch, etc.

Hand grip and foot pedal inputs 58 can also include a variety of input devices which form the operator actuable inputs within operator compartment 16. Such inputs can provide signals indicative of requested operation of the auxiliary hydraulic couplers (e.g., modulated control), requested detent, requested high speed or low speed operation in a multi-speed loader, and other requested functions (such as lift and tilt of the tool mounted to the loader, etc.).

Seat bar sensor 60 is illustratively coupled to seat bar 21. Seat bar sensor 60 illustratively provides a signal indicative of whether seat bar 21 is in the raised or lowered position illustrated in FIG. 1.

Hydraulic actuators 64 illustratively include the lift and tilt cylinders for use in manipulating tool 28 (shown in FIG. 1), a high flow valve for emitting high flow hydraulic fluid in response to a user input, a diverter valve for diverting hydraulic fluid to the auxiliary couplers in response to a user input, auxiliary relief valves, and a plurality of lockout valves for being actuated in response to operator inputs, or in response to certain sensed operating parameters. Of course, the hydraulic actuators are controlled by manipulating valve spools of valves connected between the specific actuator being controlled and a source of, or reservoir for, hydraulic fluid. Such valves include one or more primary valves controlling flow to primary hydraulic couplers and optionally one or more auxiliary valves for controlling flow to auxiliary hydraulic couplers. The valves can be controlled electronically, hydraulically or mechanically. Block 64 represents all of these elements.

Electromechanical solenoids 66 also include a wide variety of items. Some items are embodied as electrical relays which are controlled by energizing an electrical relay coil. Such electromechanical devices illustratively include a starter relay for energizing a starter, a switched power relay for providing battery power for switched power devices, a fuel shut-off relay for energizing a fuel shut-off valve, a traction lock relay for energizing a traction lock solenoid, a glow plug relay for energizing glow plugs, and light relays for controlling various lights (such as headlights, marker lights, etc.).

Display panel devices 67 are illustratively devices which receive outputs from controller 52 and indicate information to the operator. Such devices can include, for example, indicator lights, an hour meter, gauges, etc. Display panel devices 67 can be integrated with control panel inputs 54 as a unitary input and display panel, or provided separately therefrom.

In operation, controller 52 receives a variety of inputs from the control panel inputs 54, the sensor inputs 56, the hand and foot actuable inputs 58, and seat bar sensor 60. In response to those inputs, controller 54 provides outputs to hydraulic actuators 64 electromechanical devices 66 and display panel devices 67 to control various functions on loader 10.

Timing Control Circuit

FIG. 2 also illustrates that timing control circuit 70 is coupled to controller 52. Timing control circuit 70 in conjunction with controller 52, implements an hour meter which stores a time value indicative of the amount of time which power machine 10 is running. Timing control circuit 70 does this in a way which avoids corruption of the timing value and thus significantly enhances the accuracy of the hour meter.

Figure 3:
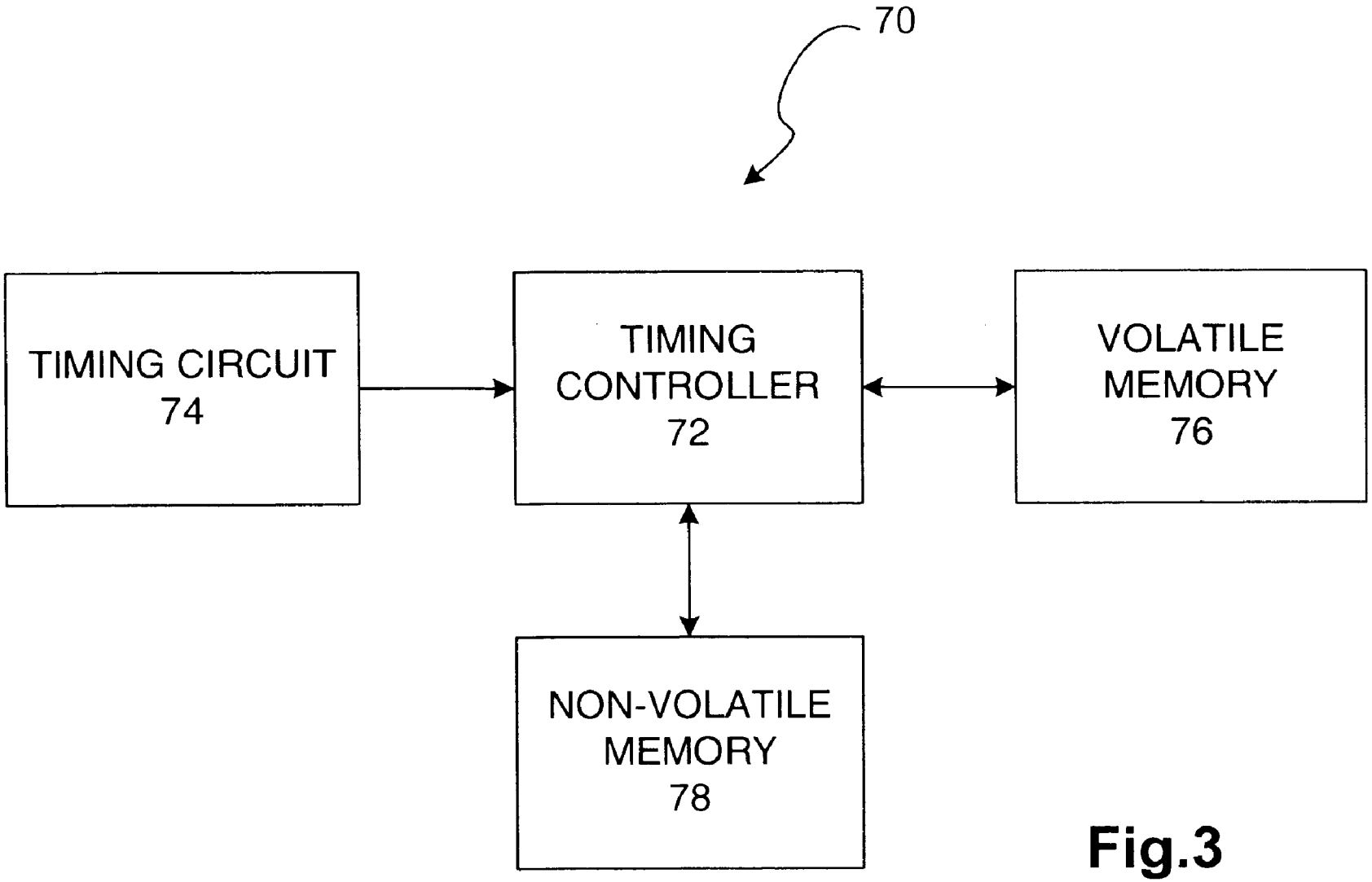
FIG. 3 is a simplified block diagram of a timing control circuit in accordance with one embodiment of the present invention.

FIG. 3 is a more detailed block diagram of timing control circuit 70. Timing control 70 includes timing controller 72, timing circuit 74, volatile memory 76 and non-volatile memory 78. It should be noted that timing controller 72 can be implemented with controller 52, or it can be implemented in a separate microcontroller, microprocessor, or other controller or digital computer.

Timing circuit 74 is illustratively a crystal oscillator based timing circuit which, when power is applied thereto, provides an oscillating timing signal, which oscillates at a desired frequency. Based on the output from timing circuit 74, timing controller 72 tracks the amount of time that power machine 10, and hence control system 50, is powered up.

Volatile memory 76 and non-volatile memory 78 are provided to store the timing values associated with the hour meter implemented by timing control circuit 70. Volatile memory 76 is used to store intermittent timing values which are indicative of the value of the hour meter while timing control circuit 70 is powered up. Non-volatile memory 78 is used to accumulate the timing values during operation and when timing control circuit 70 is powered down, such that those values can again be retrieved the next time timing control circuit 70 is powered up to continue accumulation of time.

Figure 4:
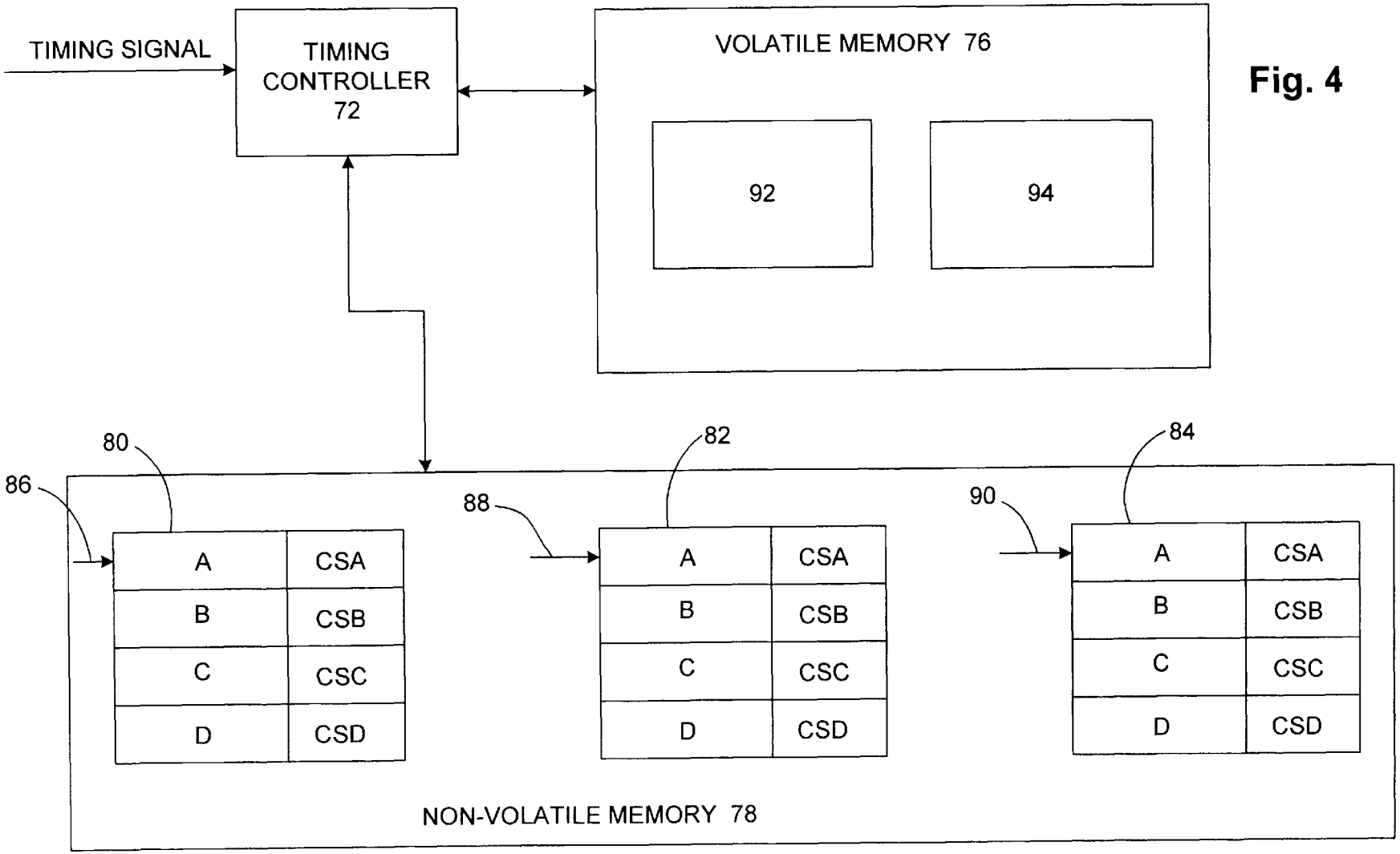
FIG. 4 is a more detailed block diagram of a portion of the timing control circuit shown in FIG. 3.

FIG. 4 is a more detailed block diagram of a portion of timing control circuit 70. FIG. 4 illustrates that non-volatile memory 78 includes, in one illustrative embodiment, three hour meter banks (or accumulators) 80, 82 and 84 within non-volatile memory 78. Non-volatile memory 78, in one illustrative embodiment, is electrically erasable programmable read only memory (EEPROM). EEPROM banks 80–84 act as hour meter accumulators, and are each divided into four blocks A–D which store the time value information indicative of the accumulated run time of power machine 10. Each accumulator 80–84 also has a second portion which is similarly broken into four separate blocks CSA–CSD. Blocks CSA–CSD contain redundancy data (such as check sum data) associated with each block A–D in accumulators 80–84. Pointers 86, 88 and 90 are associated with accumulators 80–84 and point to a currently active block (A–D) in each of hour meter accumulators 80–84, and its corresponding checksum block (CSA–CSD).

FIG. 4 also illustrates volatile memory 76 and shows that it illustratively also includes a pair of memory banks (or memory locations) 92 and 94. Briefly, during operation, timing controller 72 updates the memory banks 92 and 94, simultaneously, with the time value. After a predetermined update time period has elapsed, timing controller 72 then writes the current timing values stored in memory banks 92 and 94 in volatile memory 76 into a selected one of the accumulators 80–84. Timing controller 72 then waits for another elapsed time interval, all the while updating memory banks 92 and 94 in volatile memory 76, and then writes the time value stored in banks 92 and 94 into the next accumulator 80–84. In one illustrative example, the elapsed time interval is one-tenth of an hour. Therefore, once a tenth of an hour has expired, the time value of the hour meter stored in volatile memory 76 is written to the current accumulator (e.g. accumulator 80). After another tenth of an hour has elapsed, the current value in the hour meter in volatile memory 76 is written to the next accumulator (e.g. accumulator 82). This pattern continues until all accumulators have been written to, and timing controller 72 then again begins writing the current time value from volatile memory 76 into accumulator 80. Thus, this example creates an 18 minute cycle between writes to any single hour meter accumulator 80–84.

Initialization

Figure 5:
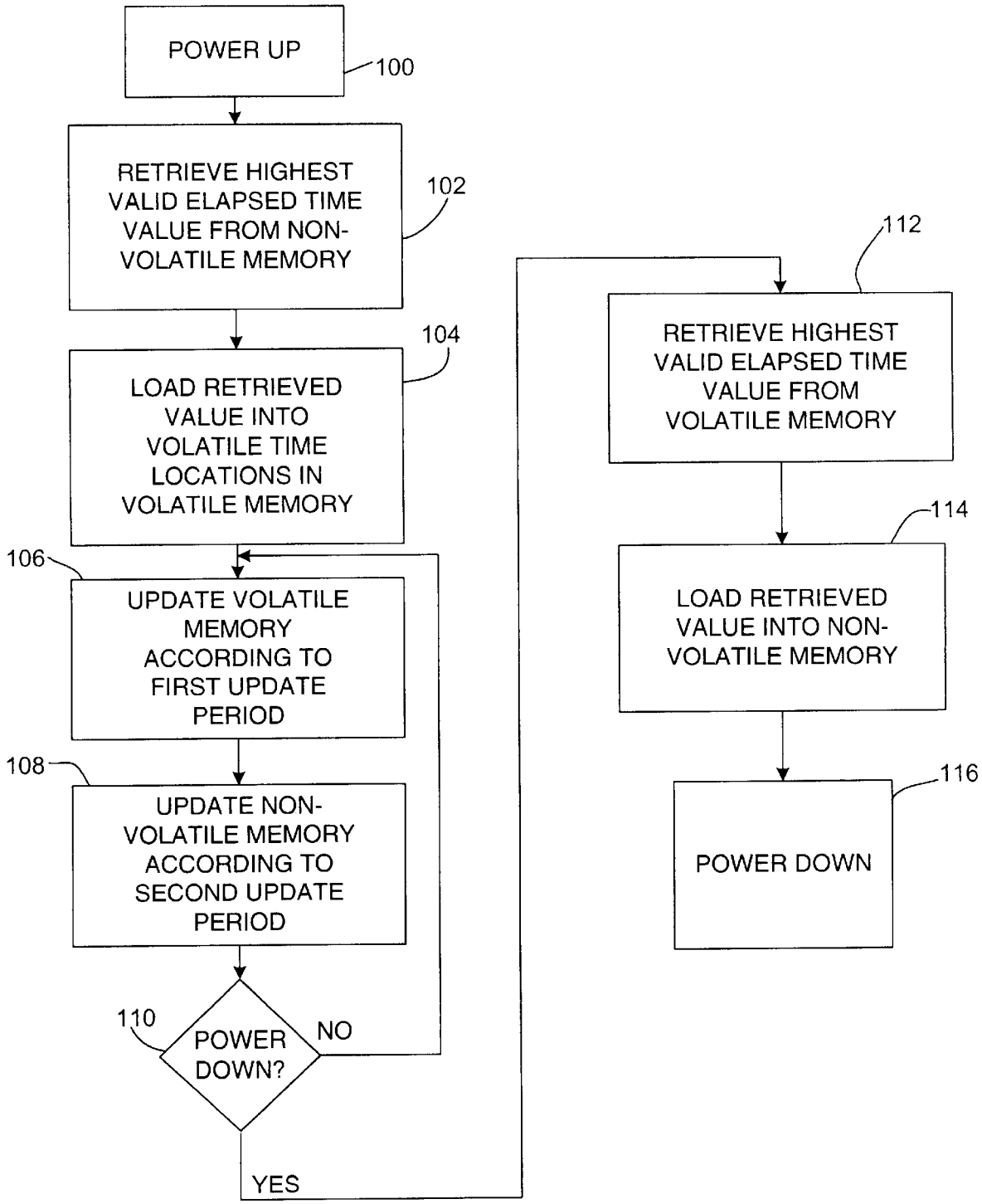
FIG. 5 is a flow diagram illustrating operation of the timing control circuit upon power-up.

FIG. 5 is a flow diagram which illustrates the initialization of the hour meter implemented in timing control circuit 70. Upon power up, indicated by block 100, timing controller 72 examines each block pointed to in the accumulators 80–84 and retrieves the highest valid elapsed time value from the accumulators 80–84 in non-volatile memory 78. This is indicated by block 102. The method by which timing controller 72 determines whether an elapsed time value stored in non-volatile memory 78 is valid is discussed in greater detail below with respect to FIG. 6.

After the highest elapsed time value has been retrieved, that value is loaded into the memory banks (or time locations) 92 and 94 in volatile memory 76. This is indicated by block 104.

Once the highest valid value is loaded into the memory locations 92 and 94 in volatile memory 76, timing controller 72 waits for a first predetermined update time interval. That interval can be any desired interval, such as 10 seconds, 30 seconds, 1 minute, etc. After the first predetermined update interval has elapsed, timing controller 72 updates the timing values stored in locations 92 and 94 in volatile memory 76. The new updated timing values are written to locations 92 and 94 substantially simultaneously, such that the two locations contain the same value. This is indicated by block 106.

Timing controller 72 continues to update the memory locations 92 and 94 in volatile memory 76 every first update time interval. Timing controller 72 also tracks a second update time interval, after which it updates the current accumulator 80–84 in non-volatile memory 78. Once the second update period has elapsed, timing controller 72 writes the current value stored in memory locations 92 and 94 in volatile memory 76 into the currently selected accumulator 80–84 in the currently selected memory blocks A–D in non-volatile memory 78. This is indicated by block 108.

It should also be noted that, during both update time intervals, timing controller 72 is periodically monitoring for a power-down condition. This is indicated by block 110. If no power-down condition is detected, timing controller 72 simply continues to update the memory locations 92 and 94 in volatile memory 76 and the accumulators 80–84 in non-volatile memory 78 according to the two update time periods. Updating the volatile and non-volatile memories 76 and 78 is discussed in greater detail with respect to FIG. 7 below.

When a power-down condition is detected, timing controller 72 retrieves the highest valid elapsed time value stored in memory locations 92 and 94 in volatile memory 76, as indicated by block 112. That retrieved value is loaded into the currently pointed to memory block A–D in the currently pointed to accumulator 80–84 in non-volatile memory 78. This is indicated by block 114. The power-down state is then entered. This is indicated by block 116.

Figure 6:
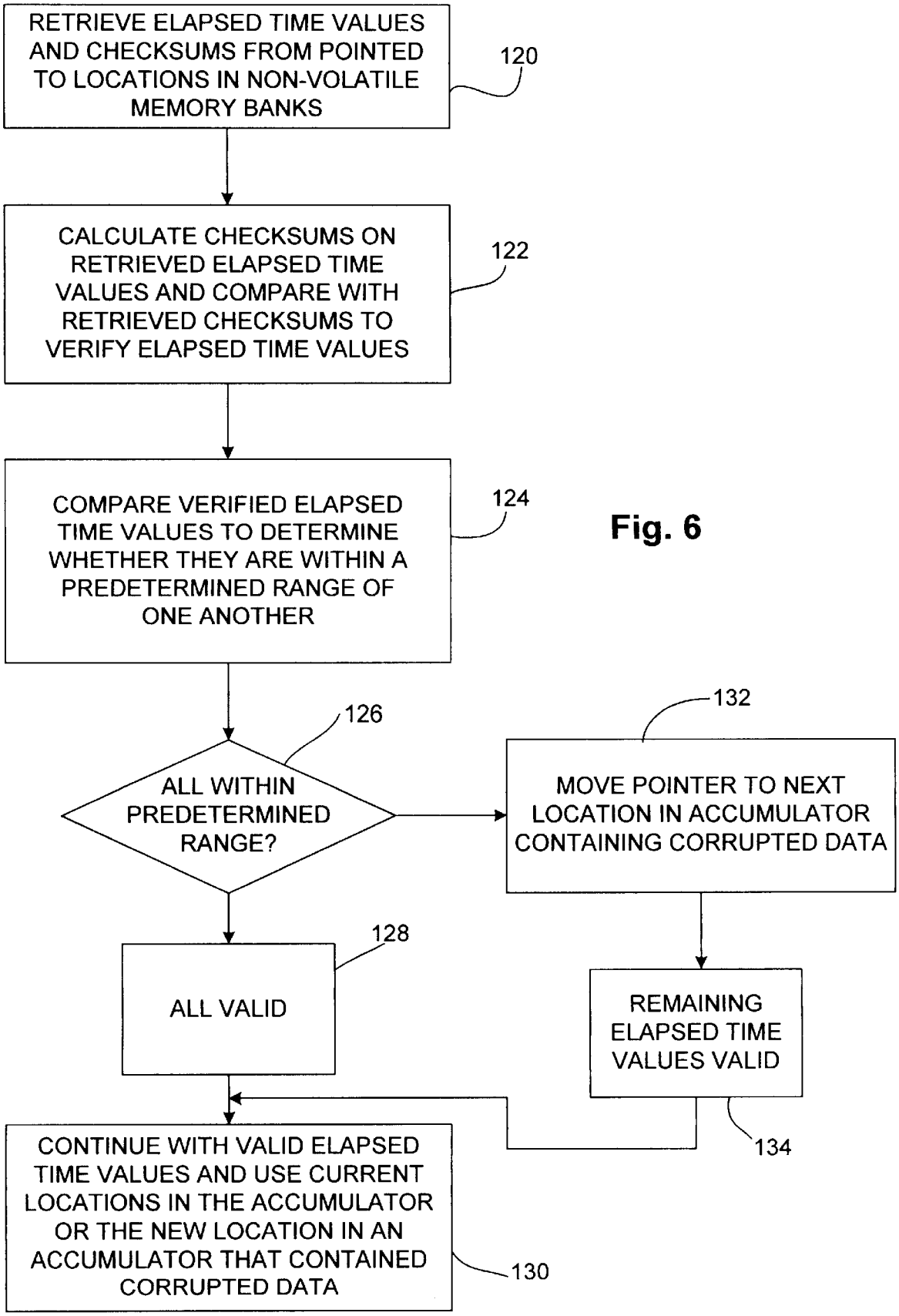
FIG. 6 is a flow diagram illustrating operation of the timing control circuit in validating non-volatile memory values in accordance with one embodiment of the present invention.

FIG. 6 is a block diagram further illustrating a method by which elapsed time values stored in accumulators 80–84 are validated during the initialization period. Of course, this validation algorithm can be performed upon power-up, on power-down, or simply periodically during operation.

First, timing controller 72 retrieves the elapsed time values and optional checksums pointed to by pointers 86–90 in accumulators 80–84. This is indicated by block 120. When the optional checksums are implemented, a conventional checksum algorithm is executed to calculate checksums on the retrieved elapsed time values. The calculated checksums are compared with the retrieved checksums, retrieved from accumulators 80–84, in order to verify the elapsed time values retrieved from accumulators 80–84. This is indicated by block 122.

Of course, when checksums are used, this can be the end of the validation process. However, when checksums are not used, or when an additional validation check is desired, the elapsed time values are then compared to one another to determine whether they are within a predetermined range of one another. For example, if the accumulators 80–84 are to be updated every tenth of an hour (i.e., every 6 minutes), then the values stored therein will never be more than 12 minutes different from one another. Comparison of the retrieved elapsed time values against one another is indicated by block 124.

If all of the retrieved elapsed time values are within the predetermined time range of one another as indicated by block 126, then timing controller 72 determines that all of the retrieved values are valid. This is indicated by block 128. Timing controller 72 thus continues with the valid elapsed time values and continues to use the current location in accumulators 80–84. This is indicated by block 130.

However, if all of the elapsed time values are not within the predetermined range of one another as indicated by block 128, then the pointer 86–90 which is associated with the particular accumulator 80–84 that contains the elapsed time value that is outside of the predetermined time range is moved to the next memory block A–D. This is indicated by block 132. After the pointer has been moved, timing controller 72 continues with the remaining elapsed time values which are valid, as indicated by block 134, and continues to use the current memory locations in the accumulators 80–84 which did not contain corrupted data, and uses the newly pointed to memory location (or memory block A–D) in the particular accumulator 80–84 which contained corrupted data. This is indicated by block 130.

Updating Hour Meter Values

Figure 7:
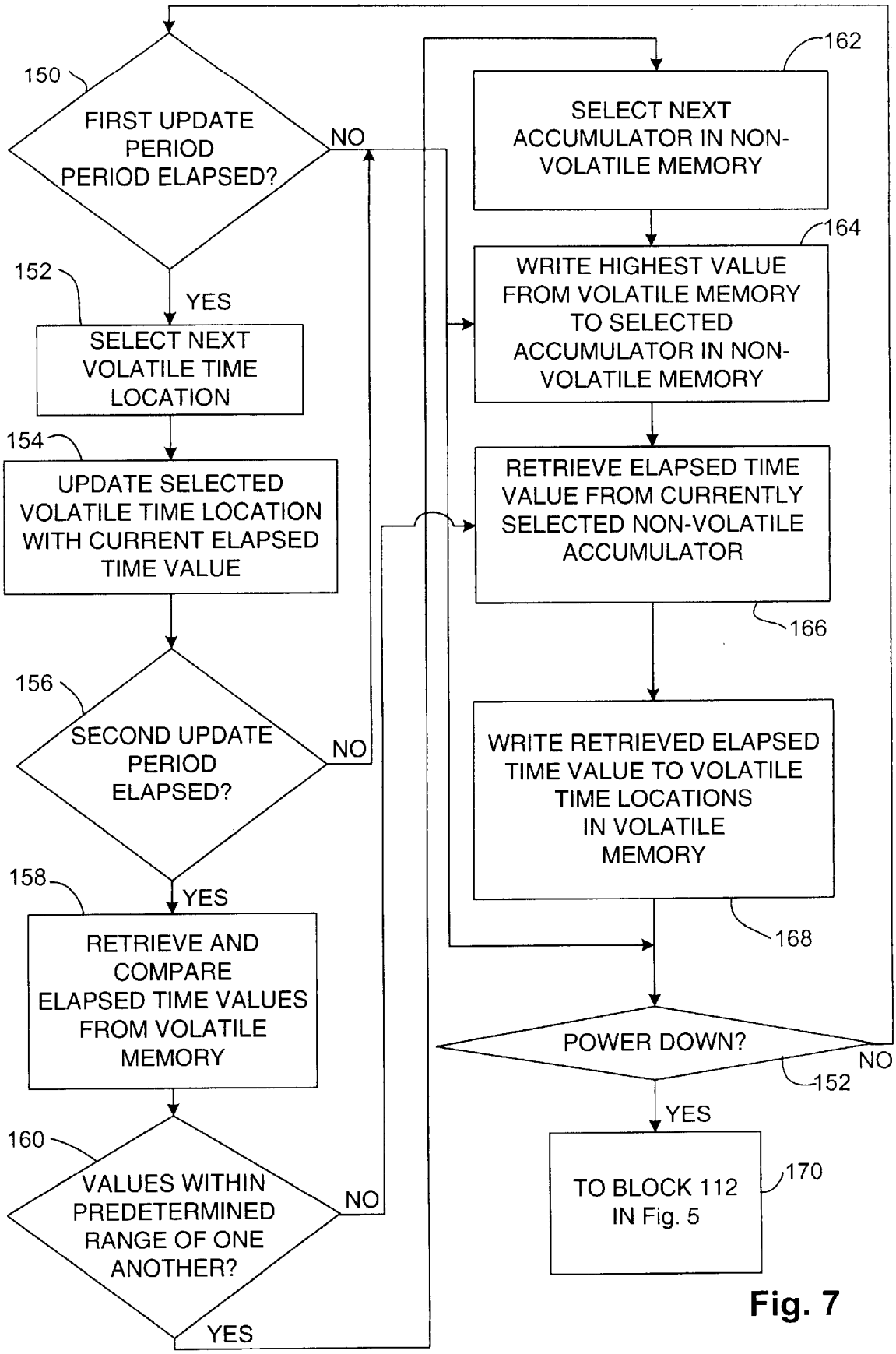
FIG. 7 is a flow diagram illustrating the operation of the timing control circuit in updating the volatile and non-volatile memory locations in accordance with one embodiment of the present invention.

FIG. 7 is a block diagram which indicates, in greater detail, how timing controller 72 updates volatile and non-volatile memories 76 and 78. It should be noted that the flow diagram set out in FIG. 7 corresponds to the blocks 106, 108 and 110 in FIG. 5.

First, controller 72 determines whether the first update time period has elapsed. This is indicated by block 150. If not, as discussed above, controller 72 intermittently detects for a power-down condition indicated by block 152. If no power-down condition is detected, controller 72 continues to monitor for whether the first update period has elapsed. It should also be noted that power-down detection and/or elapsed time period detection can be interrupt driven as well.

Once the first update time period has elapsed, controller 72 selects a location or block in volatile memory 76 and writes the current elapsed time value to volatile memory 76 (and also substantially simultaneously writes a copy of the current elapsed time value in another location or block in volatile memory 76). This is indicated by blocks 152 and 154. Controller 72 then determines whether the second update time period has elapsed. This is indicated by block 156. It should be noted that the first and second update time periods can be equal, or in one illustrative embodiment, the first update time period is less than the second update time period.

In any case, if the second update time period has elapsed, controller 172 retrieves and compares the elapsed time values from volatile memory 76. This is indicated by block 158. If the retrieved values are within a predetermined range of one another (such as if they are identical or spaced a short time distance apart) then it is determined that the values stored in the volatile memory are valid, and the next accumulator to be updated in non-volatile memory 78 is selected. This is indicated by blocks 160 and 162.

The highest elapsed time value retrieved from volatile memory 76 is then written into the selected accumulator 80–84 in non-volatile memory 78. This is indicated by block 164. The process then repeats itself.

If, at block 160, it was determined that the values in volatile memory 76 are not within a predetermined range of one another, then controller 72 determines that it must update volatile memory 76 with a valid elapsed time value. Controller 72 thus retrieves the elapsed time value from the currently selected accumulator in non-volatile memory 78. This is indicated by block 166. That value is then written to the volatile time locations in volatile memory 76, and then the update process begins anew. This is indicated by block 168.

If, at any time during the update process, a power-down condition is detected at block 152, processing continues at block 112 in FIG. 5. This is indicated by block 170.

Figure 8:
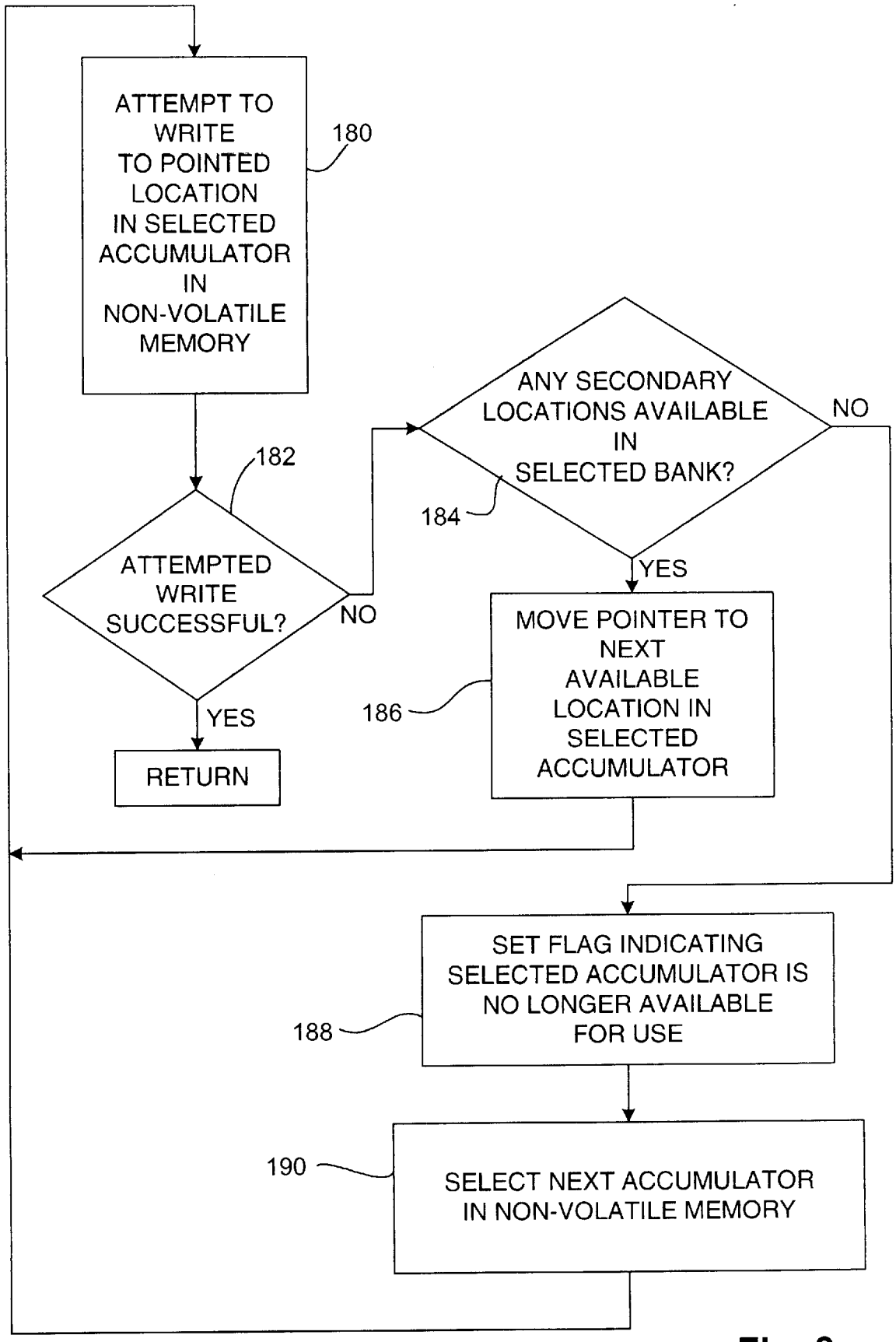
FIG. 8 is a flow diagram illustrating an operation of a timing control circuit in writing to a selected non-volatile memory location.

FIG. 8 is a flow diagram illustrating how controller 72 writes the time values from volatile memory 76 to accumulators in non-volatile memory 78, and how it processes errors in those memory locations. This process corresponds to block 164 in FIG. 7.

First, controller 72 attempts to write to the pointed to location in the selected accumulator 80–84 in non-volatile memory 78. This is indicated by block 180. Controller 72 then determines whether that attempted write operation was successful. This is indicated by block 182. Controller 72 can make this determination in any number of suitable ways. For example, controller 72 can simply write to the desired accumulator and read that value back and compare it to the written value, or it can read back the written value and do a checksum calculation and comparison.

If the write operation is determined to be successful, that ends the operation. However, if the write operation is unsuccessful, then it is determined whether there are any additional secondary locations A–D in the selected accumulator 80–84. This is indicated by block 184. If there are secondary locations A–D available, then controller 72 moves the associated pointer 86–90 to the next available location A–D in the selected accumulator. This is indicated by block 186.

However, if at block 184, it is determined that there are no secondary locations A–D available in the selected accumulator 80–84, then this indicates that all memory locations in the selected accumulator have been corrupted or are no longer functioning properly. Therefore, controller 72 sets a flag indicating that the selected accumulator is no longer available for use in the electronic clock implementation. This is indicated by block 188. Next, controller 72 selects the next accumulator in non-volatile memory 78, as indicated by block 190, and continues intermittently writing between the two remaining accumulators to implement redundancy in the electronic clock.

It can thus be seen that the present invention provides a high degree of accuracy in the electronic hour meter implemented in power machine 10. The accuracy is obtained even though corrupted data may be written to one or more memory locations, and even though wildly incorrect time values are obtained during power down.

Although the present invention has been described with reference to preferred embodiments, workers skilled in the art will recognize that changes may be made in form and detail without departing from the spirit and scope of the invention.

What is claimed is:

1. A method of maintaining clock data indicative of time of operation of a power machine, comprising:

providing a plurality of clock locations in non-volatile memory;

receiving a clock signal indicative of elapsed time; and intermittently writing clock data, indicative of elapsed time, to a first subset, and subsequently to a second subset, of the plurality of clock locations such that, clock data in the first subset of clock locations is different from clock data in the second subset of clock locations.

2. The method of claim 1 wherein intermittently writing clock data comprises:

periodically writing current clock data to different successive clock locations.

3. The method of claim 2 wherein intermittently writing clock data comprises:

upon power down of the power machine, writing the current clock data to the next successive clock location.

4. The method of claim 2 wherein intermittently writing clock data comprises:

updating the current clock data in a volatile memory based on the clock signal; and periodically writing the current clock data, then contained in the volatile memory, to the next successive clock location.

5. The method of claim 4 wherein updating the current clock data comprises:

upon power up of the power machine, determining which of the plurality of clock locations in non-volatile memory contains a highest elapsed time value; and writing the highest elapsed time value to the volatile memory.

6. The method of claim 5 wherein determining which of the plurality of clock locations contains the highest elapsed time value comprises:

determining which of the elapsed time values in memory are valid; and comparing the valid elapsed time values to determine which is the highest.

7. The method of claim 6 wherein determining which of the elapsed time values are valid comprises:

comparing the elapsed time values in the clock locations in non-volatile memory to determine whether they differ from one another by less than a predetermined offset value associated with the period on which the clock locations are written.

8. The method of claim 6 wherein determining which of the elapsed time values in non-volatile memory are valid comprises:

obtaining a previous stored checksum value associated with each of the elapsed time values; and comparing it with a currently calculated checksum value associated with each of the elapsed time values.

9. The method of claim 4 wherein updating the current clock data in a volatile memory, comprises:

intermittently writing current clock data to a different one of a plurality of temporary clock locations in volatile memory.

10. The method of claim 9 wherein periodically writing the current clock data, then contained in volatile memory to the next successive clock location, comprises:

comparing the clock data contained in the temporary clock locations to determine whether they differ by less than a predetermined offset value associated with a frequency with which they are updated;

if so, writing clock data in a temporary clock location which is indicative of a highest elapsed time value to the next successive clock location in non-volatile memory; and if not, writing a highest elapsed time value then in the clock locations in non-volatile memory to the temporary clock locations in the volatile memory.

11. The method of claim 2 wherein periodically writing current clock data to different successive clock locations in non-volatile memory comprises:

selecting the next successive clock location in non-volatile memory;

attempting to write the current clock data to a first memory location associated with the selected clock location in non-volatile memory;

determining whether the attempted write was successful;

if not, attempting to write the current clock data to a next memory location associated with the selected clock location in non-volatile memory; and repeating the steps of determining whether the write was successful and attempting to write to a next memory location until the attempted write is successful or a predetermined number of attempts have been made; and if the attempted write is still unsuccessful selecting the next subsequent successive clock location in non-volatile memory.

12. A clock storing time data indicative of time of operation of a power machine, the clock comprising:

a timing circuit providing a timing signal;

a memory having a plurality of time locations; and a controller coupled to the timing circuit and the memory, the controller maintains an elapsed time value, based on the timing signal, and selects a first time location of the plurality of time locations and updates the selected first time location with the elapsed time value and, after a first update time period, updates a subsequently selected second time location with a first updated elapsed time value.

13. The clock of claim 12 wherein the first time location and the second time locations are successive time locations in memory and wherein the controller performs successive write operations to write an updated elapsed time value to each successive time location in memory, the successive write operations being separated by an update period during which the elapsed time value is updated.

14. The clock of claim 13 wherein the memory comprises a non-volatile memory.

15. The clock of claim 14 wherein each of the plurality of time locations has a predetermined number of associated secondary locations and wherein the controller is configured to determine whether each successive write operation is successful and, if not, attempts to perform the successive write operation in on of the secondary locations.

16. The clock of claim 14 wherein the memory includes a volatile memory and wherein the controller maintains the elapsed time value by periodically updating a volatile time location in the volatile memory based on the timing signal.

17. The clock of claim 16 wherein the volatile memory includes a plurality of volatile time locations and wherein the controller maintains the elapsed time value by successively updating one of the volatile time locations after a volatile time update period.

18. The clock of claim 17 wherein the volatile time update period is shorter than the update time period for updating the time location in non-volatile memory.

19. The clock of claim 17 wherein the controller compares the elapsed time values in the plurality of volatile time locations, to ensure that they differ by less than a predetermined amount, prior to performing each of the successive write operations to the time locations in the non-volatile memory.

20. The clock of claim 17 wherein the controller, upon power up, determines which of the time locations in non-volatile memory contains a highest valid elapsed time value and writes the highest valid elapsed time value to at least one of the volatile time locations in the volatile memory.

21. The clock of claim 17 wherein the controller, upon power down, updates a time location in non-volatile memory with a highest valid elapsed time value in the volatile time locations in the volatile memory.

* * * * *

UNITED STATES PATENT AND TRADEMARK OFFICE

CERTIFICATE OF CORRECTION

PATENT NO. : 6,552,965 B2 
DATED : April 22, 2003
INVENTOR(S) : Kenneth A. Brandt et al.

It is certified that error appears in the above-identified patent and that said Letters Patent is hereby corrected as shown below:

Column 10,
Lines 51-52, after "controller" delete "is configured to"
Line 52, change "determine" to -- determines --.
Line 54, change "on" to -- one --.

Signed and Sealed this

Ninth Day of September, 2003

JAMES E. ROGAN
*Director of the United States Patent and Trademark Office*